United States Patent [19]

Reddy

[11] 4,153,826

[45] May 8, 1979

[54] ACTUATING MECHANISM FOR ELECTRICAL SWITCHES

[75] Inventor: Redreddy S. Reddy, Schaumburg, Ill.

[73] Assignee: Vapor Corporation, Chicago, Ill.

[21] Appl. No.: 734,389

[22] Filed: Oct. 21, 1976

[51] Int. Cl.[2] ..... H01H 27/06

[52] U.S. Cl. ..... 200/44; 70/421

[58] Field of Search ..... 200/42 R, 44, 68; 70/421; 49/35; 340/163

[56] References Cited

U.S. PATENT DOCUMENTS

| | | | |
|---|---|---|---|
| 3,270,151 | 8/1966 | Godette | 200/44 |
| 3,425,248 | 2/1969 | Duval | 70/421 |
| 3,632,916 | 1/1972 | Schaad | 200/42 R |

*Primary Examiner*—Samuel W. Engle
*Assistant Examiner*—Ralph Palo
*Attorney, Agent, or Firm*—Francis J. Lidd

[57] ABSTRACT

An actuating mechanism for actuating electrical switches to insure coordinated connection of circuits vital to safe operation of a mass-transit vehicle includes a frame upon which are mounted one or more electrical switches. Also included is a cam rotatably mounted on the frame for actuating engagement with the switches upon rotation of the cam by key or similar device. The actuating mechanism further includes a toggle mechanism that is connected at one end to the frame and at the other end to the cam at a point spaced from the point of mounting of the cam to the frame. Secured to the toggle mechanism is a spring whose dead center position does not coincide with the point of actuating contact of the cam with the switch such that upon rotation of the cam, the spring resists movement of the cam until the dead center position of the spring is reached. As the cam is rotated beyond the dead center position of the spring, the spring assists in the rotation of the cam through the point of actuating contact with the electrical switches. The actuating mechanism further includes a lock arrangement for locking the cam against rotational movement.

14 Claims, 7 Drawing Figures

ACTUATING MECHANISM FOR ELECTRICAL SWITCHES

BACKGROUND OF THE INVENTION

A. Field of the Invention

The present invention relates to mechanisms for actuating electrical switches in electrical circuits of the type employed for energizing various components of a mass-transit vehicle.

B. Description of the Prior Art

Mass transit vehicles often include a switch designated as a crew switch that is readily accessible to a crew member through the employment of key or similar device. The crew switch controls various components of the transit vehicles such as the warning lights, the doors, and automatic train operation of the vehicle in a coordinated train.

Typical prior art crew switches employ one or more sets of contacts that are opened and closed in response to the insertion and rotation of a key or similar device. An example of such a typical crew switch is illustrated in U.S. Pat. No. 3,561,160 assigned to the assignee of the present invention.

Prior art crew switches have the disadvantage of being susceptible to manipulation by a crew member to actuate one or more but not all of the electrical switches controlled by the crew switch. Consequently, critical and sometimes vital circuits are not energized by the crew member while other circuits are energized allowing the crew member to accomplish non-standard operation of the train or transit vehicle in a dangerous condition. For example, during maintenance of the transit vehicle, manipulation or "teasing" of the crew switch in order to establish local control can allow doors to open while the train is in motion. "Defeating" or non energization of warning light circuits designed to alert other crew members of non standard car operation can also occur resulting in operation of the transit vehicle without automatic control functions greatly increasing the probability of car collisions, and other situations resulting in personal injury and material damage.

Accordingly, it is desirable to provide a crew switch that is operative in one mode of operation or another and is incapable of being manipulated or "teased" into an intermediate position so as to energize some but not all of the electrical switches. At the same time, rugged construction capable of withstanding rough handling, adverse climatic conditions, vandalism, and other aspects of transit car operation over an extended period of time must be provided. As an indication of the extraordinary performance required in the transit industry, warrantees of eight years are commonly required on door operating systems. Vandalism, mentioned above, creates an additional and stringent requirement for a crew switch in that unauthorized operation must be prevented through key action. However, the key and operating mechanism must resist efforts to "pick" the switch, or more usually, destructive actions aimed at making the entire switch inoperative. One approach to providing such a crew switch is to include in the switch a cam and a resiliently biased cam follower wherein the cam includes large abutments or projections behind the cam follower. An example of this type of switch is illustrated in U.S. Pat. No. 2,794,103. This prior art switch is expensive due to the elaborate configuration of the cam and is susceptible of being manipulated or teased once the projections are worn to a degree such that a level surface on which the cam follower may sit is formed. Additionally, the construction and operating life would not meet transit car requirements as outlined above.

Another prior art procedure for preventing manipulation of a switch actuating mechanism includes a spring that serves to bias the switch to one mode of operation or the other. The switch must then be held in the different modes against the bias of the spring. This is accomplished by a locking apparatus such as a cam and cam follower. An example of this type of prior art switch is illustrated in U.S. Pat. No. 3,302,484. This type of prior art switch is expensive due to the employment of two torsion springs, a cam, and a cam follower and is bulky due to the several additional components. Operation of this switch in the transit car environment is also questionable.

SUMMARY OF THE INVENTION

An object of the present invention is to provide a new and improved mechanism for actuating electrical switches.

Another object of the present invention is to provide a new and improved method for actuating one or more electrical switches while preventing actuation of fewer than all of the electrical switches.

Another object of the present invention is to provide a new and improved actuating mechanism for actuating electrical switches that is only operable to distinct modes and is not capable of being manipulated to positions intermediate of the distinct modes.

Briefly, the above and other objects of the present invention are achieved by providing an actuating mechanism for an electrical switch that includes a frame on which one or more electrical switches are mounted. The mechanism further includes a cam rotatably mounted on the frame in a position such that the cam will actuate the electrical switches. Also secured to the frame is a latch that locks the cam in a desired position and must be released in order to rotate the cam.

In accordance with an important feature of the present invention, there is provided a toggle mechanism that prevents the cam from being rotated to and held in a position between distinct modes of operation. The toggle mechanism is secured to the frame and to the cam and includes a spring whose dead center position does not coincide with the actuating contact of the cam with the switches. Accordingly, during initial rotation of the cam and prior to the actuating abutment of the cam with the electrical switches, the toggle mechanism resists movement of the cam until the dead center position of the spring is reached. Once the cam is rotated beyond the dead center position, the toggle mechanism assists in rotating the cam through the remaining portion of the cam's rotational movement and into engagement with the electrical switches.

The cam may be rotated by a key or similar device that is inserted into the frame into mechanical engagement with the cam. The insertion of the key disengages the lock and allows the cam to be rotated, and provides an additional indication of authorized use.

The present invention together with the above and other objects and advantages will best appear from the following detailed description of an illustrative embodiment shown in the accompanying drawings, wherein.

DETAILED DESCRIPTION OF A PREFERRED EMBODIMENT

Figures 1, 2:
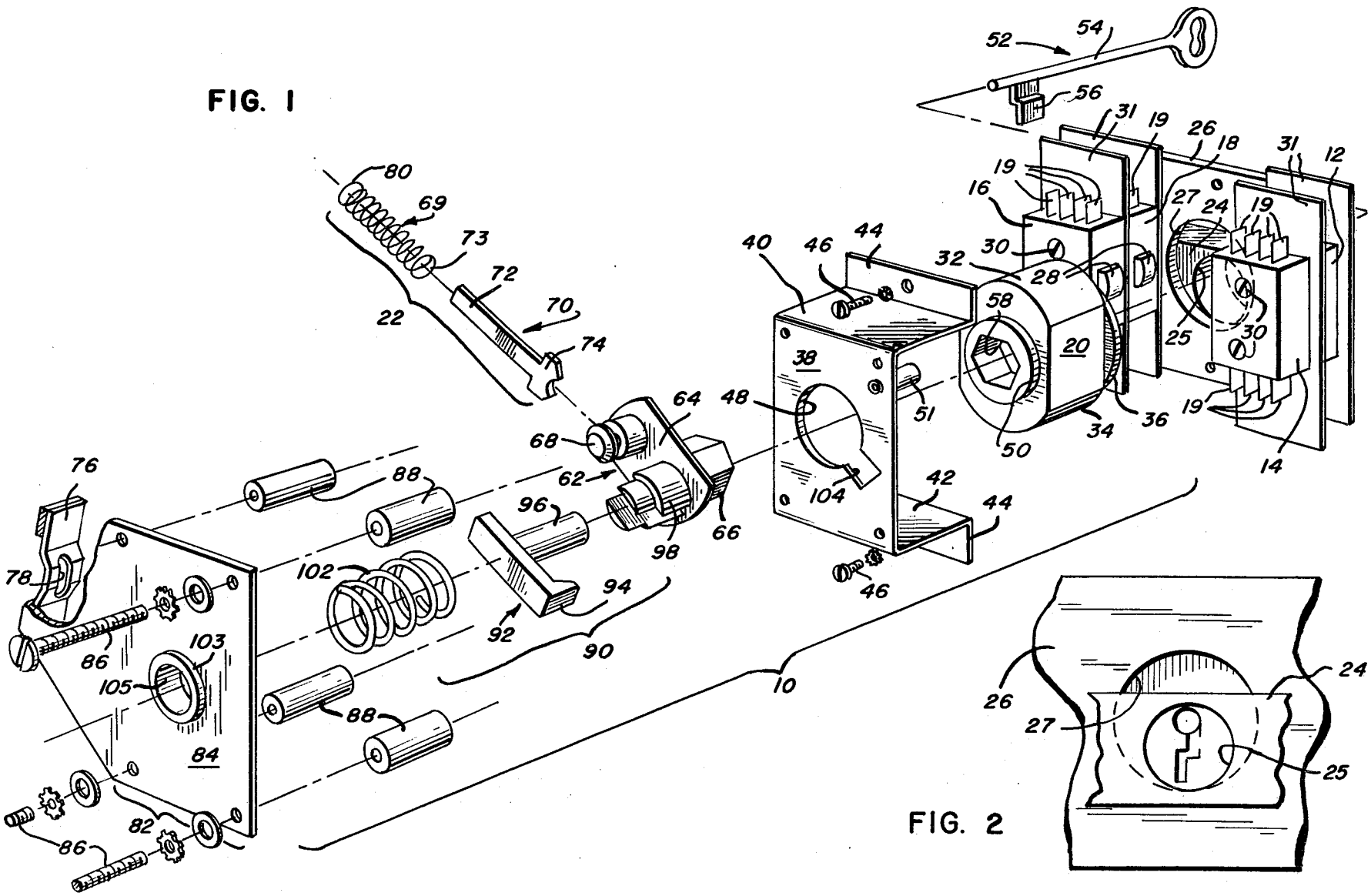
FIG. 1 is an exploded view of an actuating mechanism and switch assembly constructed in accordance with the principles of the present invention.
FIG. 2 is a fragmentary view of the mounting plate and key hole of the mechanism illustrated in FIG. 1.
Figure 3:
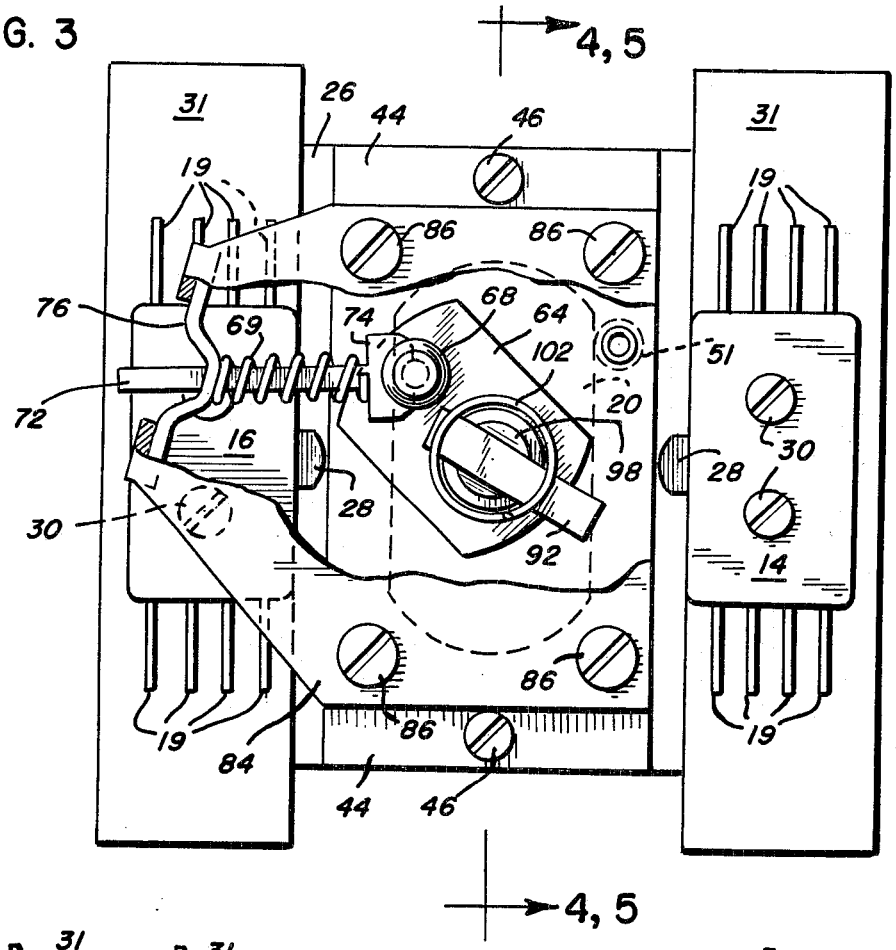
FIG. 3 is a partially cut-away, front view of the mechanism of the present invention.
Figure 4:
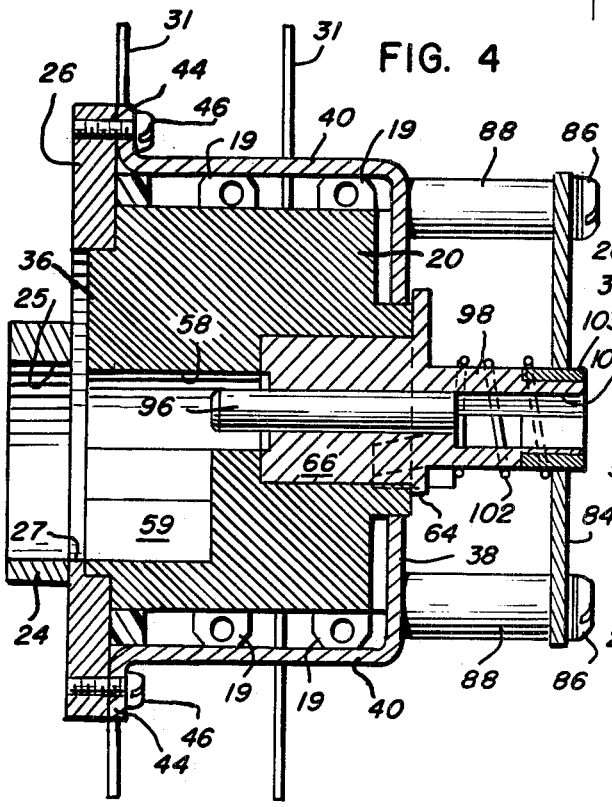
FIG. 4 is a view taken along line 4—4 of FIG. 3.

With reference to the drawings and initially to FIG. 1, there is illustrated an electrical switch assembly or crew switch generally designated as 10. The crew switch 10 may be of the type employed in transmit vehicles to control a circuit for energizing various components of the vehicle. Such a vehicle and its various components and related circuits are disclosed in U.S. Pat. No. 3,561,160.

The assembly 10 includes a plurality of snap action switches 12, 14, 16 and 18, the number depending on the number of different circuits to be controlled by the assembly 10. The switches 12, 14, 16 and 18 each include a number of terminals 19 that are electrically coupled to the various components of the vehicle. To actuate the switches 12, 14, 16 and 18, the assembly 10 also includes a cam 20.

In accordance with an important feature of the present invention, the cam 20 is operable into distinct modes that correspond to distinct operative modes of the switches 12, 14, 16 and 18. More specifically, to prevent the cam 20 from being rotated to a position wherein the switches 12, 14, 16 and 18 are not all in the same operative mode, the assembly also includes a toggle mechanism generally designated by the numeral 22.

With reference to the specific structure of the assembly 10, as previously mentioned, the assembly 10 is mounted in a transit vehicle in a location readily accessible to operating personnel. To allow this securement, the assembly 10 includes a mounting plate 24 to which the entire assembly 10 is secured and which may be secured to the desired vehicle. The plate 24 includes an aperture 25 through which an instrument such as a key may be inserted. A cam positioning and centering plate 26 having a central aperture 27 is secured to the mounting plate 24 and serves to center the cam 20 relative to the assembly 10 in a manner to be described.

The switches 12, 14, 16 and 18 each include an actuating plunger 28 that upon being depressed, actuates the respective switch 12, 14, 16 and 18 into an operative mode. The switches 12, 14, 16 and 18 are stacked and mounted to the plates 24 and 26 by several screws 30. The switches 12, 14, 16 and 18 are separated from each other in their stacked configuration by sheets of insulation 31. The switches 12, 14, 16 and 18 are mounted on the plates 24 and 26 such that their respective actuating plungers 28 extend toward the aperture 27.

To depress the plungers 28 and thus actuate the switches 12, 14, 16 and 18, the cam 20 is provided. The cam 20 includes switch actuating surfaces 32 and 34 intended to engage the plungers 28. The cam 20 includes a circular flange 36 integrally formed thereon of a dimension to fit within the aperture 27 of the cam plate 26. Upon placing the flange 36 into the aperture 27, the cam 20 is centrally positioned relative to the switches 12, 14, 16 and 18 and may rotate within the aperture 27 relative to the assembly 10.

The cam 20 is rotatably held within the assembly 10 by a stop bracket 38. The bracket 38 includes a pair of legs 40 and 42 each including a flange 44 that is positioned upon and secured to the mounting plate 24 by several fasteners 46. The bracket 38 includes a circular aperture 48 that engages and holds the cam 20. More specifically, the cam 20 includes a raised portion 50 of substantially the same dimension and configuration as the aperture 48. Since the aperture 48 and raised portion 50 are circular, the bracket 38 holds the cam 20 in the assembly 10 while allowing rotation of the cam 20. In addition, a pin 51 is mounted on the bracket 38 to engage the cam 20 and prevent a complete 360° rotation of the cam 20.

To actuate the switches 12, 14, 16 and 18 into their operative modes, the cam 20 may be rotated by a key 52 that includes a shaft 54 and a tooth 56 affixed to the shaft 54 in a position such that a portion of the shaft 54 extends beyond the tooth 56.

The cam includes a central aperture 58 that is of a slot configuration 59 in that portion of the aperture 58 adjacent the flange 36. This slot configuration 59 of the aperture 58 mates with the configuration of the tooth 56 such that upon insertion of the key 54 into the aperture 27 of the plate 24, the tooth 56 will be inserted into and engage the slot portion of the aperture 58. In this manner, rotation of the key 54 will impart rotation to the cam 20. As the cam 20 is rotated, the surfaces 32 and 34 will simultaneously engage the respective plungers 28 of the switches 12, 14, 16 and 18 actuating them into an operative mode.

The assembly 10 also includes an important safety feature that prevents manipulation to actuate some but not all of the switches 12, 14, 16 and 18 into an operative mode. To prevent manipulation, the assembly 10 includes a toggle mechanism 22. The toggle mechanism 60 imparts a biasing force to the cam 20 such that the cam 20 cannot be rotated and held in a position to actuate some but not all of the switches 12, 14, 16 and 18 into a given operative mode.

The toggle mechanism 22 is mechanically coupled to the cam 20 by a shaft and pin assembly 62. The shaft and pin assembly 62 includes a plate 64 to which is secured a multisided shaft 66. The shaft 66 is inserted through the aperture 48 in the bracket 38 and into the aperture 58 in the cam 20 and, specifically, into that portion of the aperture 58 that is adjacent the raised portion 50. This portion of the aperture 58 is fabricated in a configuration to mate with the shaft 66 such that rotation of the cam 20 is imparted to the shaft and pin assembly 62 through this connection. The member 66 is mounted and aligned with the aperture 58 such that the axis of rotation of the cam 20 is on line with the central axis of the aperture 58 and the shaft 66.

The shaft and pin assembly 62 also includes a pin 68 secured to the plate 64 at a point spaced from the axis of rotation of the cam 20. The pin 68 serves to mechanically connect the biasing force to the cam 20. More specifically, the biasing force is provided by a compression spring 69 and is imparted to the cam 20 through the shaft and pin assembly 62 by a toggle 70. The toggle 70 includes a shaft 72 and an enlarged end 74. The end 74 is of a dimension larger than the diameter of the spring 69. In this manner, the spring 69 may be placed around the shaft 72 with a first end 73 abutting the end 74. The end 74 includes a rounded slot that engages and partially captures the pin 68. The engagement is such that the pin 68 may rotate relative to the toggle 70 while maintaining the engagement with the end 74.

The toggle and spring 69 are mounted relative to the assembly 10 by a toggle support 76. The toggle support 76 includes a slot 78 through which the shaft 72 of the toggle 72 entends in a manner such that a second end 80 of the spring 69 abuts the support 76. The toggle support 76 is secured by welding or other means to a guide and toggle support assembly 82. The guide and toggle support assembly 82 includes a plate 84 to which the toggle support 76 is secured. The plate 84 is secured to and spaced from the stop bracket 38 by fasteners 86 and spacers 88. In this configuration, the mounting plate 24 the stop bracket 38, and the plate 84 define a frame or housing for containing the various components of the assembly 10.

The cam 20 may be locked in a selected or normal mode relative to the assembly 10 by a lock mechanism 90. The lock mechanism 90 includes a plunger generally designated by the numeral 92. The plunger 92 includes a pawl 94 and a shaft 96 secured to the pawl 94. To connect the lock mechanism to the cam 20, the shaft and pin assembly 62 includes a bifurcated projection 98 opposite member 66. An aperture 100 extends through the projection 98, the plate 64, and member 66. The plunger 92 is slideably mounted on the shaft and pin assembly 62 by the insertion of the shaft 96 into the aperture 100, and the plunger 92 is biased into a position such that the pawl 94 is located between the bifurcations of the projection 98 by a compression spring 102. The spring 102 is positioned between the plate 84 and the plunger 92 and abuts the plate 84 at one end and the plunger 92 at the other end.

Once assembled, the projection 98 will extend into a bearing 103 mounted in an aperture 105 in the plate 84 wherein the projection 98 and the assembly 62 may rotate relative to the plate 84.

When the plunger 92 is biased between the bifurcations of the projection 98 by the spring 102, the pawl 94 extends into a slot 104 fabricated in the bracket 38 when the assembly 10 and cam 20 are in the normal position or mode. The engagement of the pawl 94 with the slot 104 in this position locks the shaft and pin assembly 62 relative to the assembly 10. In this manner, the cam 20 is also locked in position relative to the assembly 10.

Figure 5:
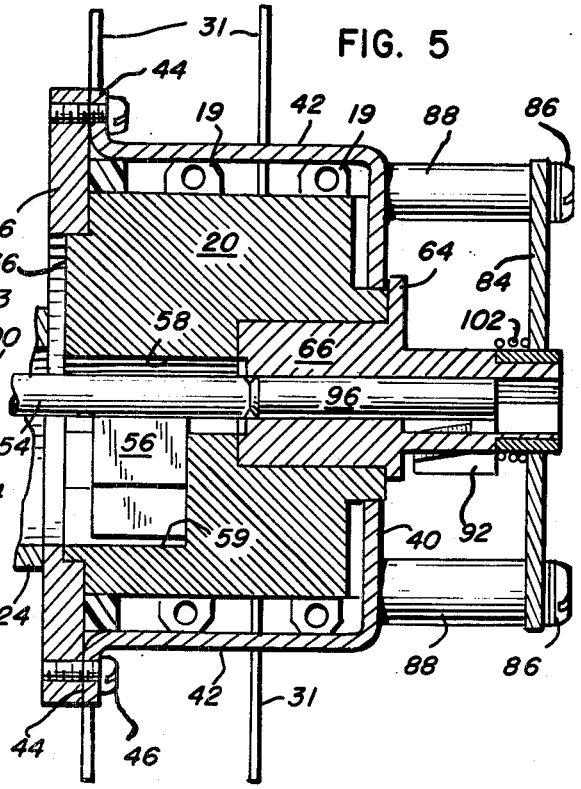
FIG. 5 is a view taken along line 5—5 in FIG. 3 with a key inserted in the mechanism.

To operate the assembly 10 in order to actuate the switches 12, 14, 16, and 18, the key 54 is inserted into the key hole 25 such that the tooth 56 is positioned in the slot portion 59 of the aperture 58 in the cam 20. The end of the shaft 54 of the key 52 extends through the cam 20, the aperture 48 and into the aperture 100 to engage the shaft 96 of the plunger 92 (FIG. 5). Further axial insertion of the key 54 forces the plunger 92 against the spring 102 lifting the pawl 94 out of the slot 104. This action unlocks the cam 20 (FIG. 5).

Figure 6:
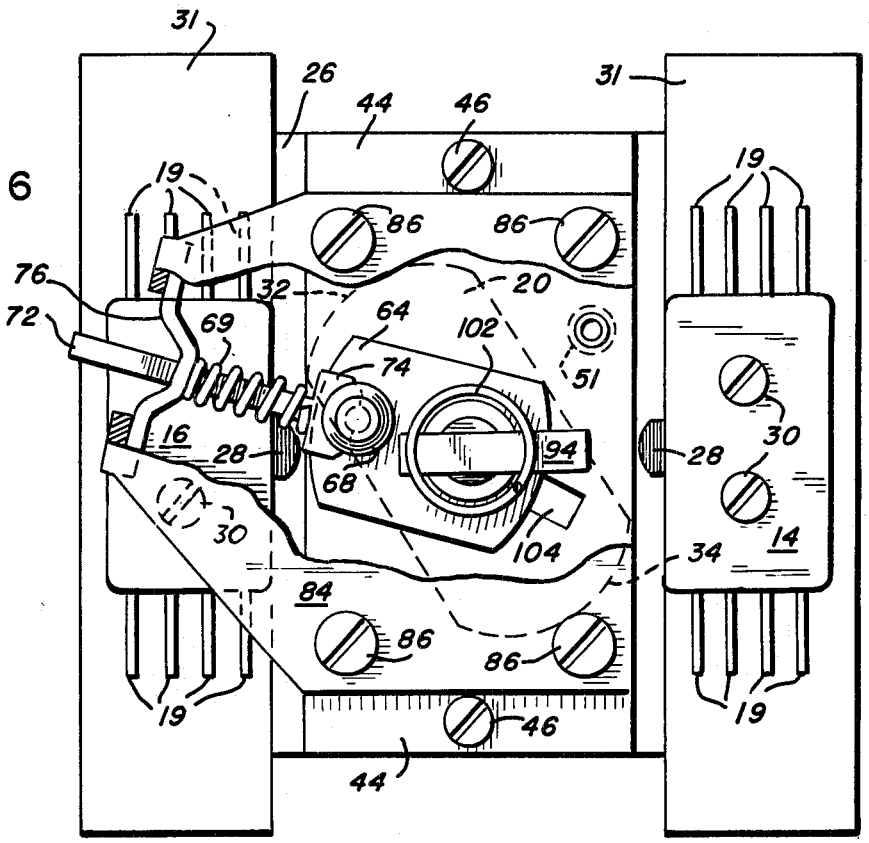
FIG. 6 is a partially cut-away, front view of the mechanism of the present invention with the cam of the mechanism partially rotated.
Figure 7:
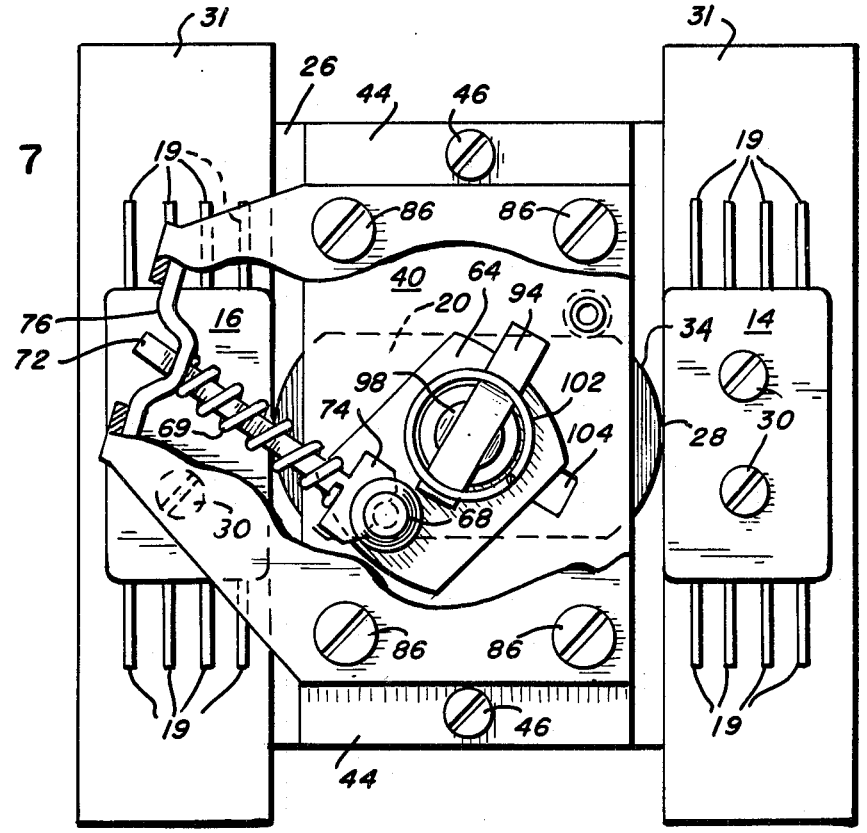
FIG. 7 is a view similar to FIG. 6 with the cam rotated to a switch engaging position.

Once the cam 20 is unlocked, the key 54 may be rotated thereby rotating the surfaces 32 and 34 toward the plungers 28 of the switches 12, 14, 16 and 18 (FIG. 6). During this initial rotation of the cam 20, the shaft and pin assembly 62 is also rotated pushing the toggle 70 into the slot 78 of the toggle support 76 and compressing the spring 69. The compression of the spring 69 imparts a force to resist the rotation of the cam 20 through the shaft and pin assembly.

As the cam 20 is further rotated, the cam reaches an angular position where the surfaces 32 and 34 almost abut the plungers 28 (FIG. 6). At this angular position, the spring 69 is at its dead center position and the biasing force of the spring 64 is directed through the axis of rotation of the cam 20. Accordingly, the assembly 10 is in a force equilibrium position such that no biasing force is imparted by the spring 69 to the cam 20. However, since the cam 20 does not abut the plungers 28, the switches 12, 14, 16 and 18 are not actuated. In order to actuate the switches 12, 14, 16 and 18, the key 54 must be further rotated. As this occurs, the toggle mechanism 60 is moved beyond the dead center position of the spring 69 and the spring 69 again imparts a force to the cam 20 tending to rotate the cam 20. Consequently, as the cam 20 is further rotated to engage the plungers 28, the cam 20 cannot be positioned to engage less than all the plungers 28 since the force of the spring 69 is sufficient to rotate the cam 20 into engagement with and beyond the plungers 28.

The above procedure is reversed if the key 54 is rotated from its final position to its initial, key insertion position.

As a result of the axial insertion of the key 54 and the resultant actuation of the lock mechanism 90, the assembly 10 may also include an additional control sequence if desired. For example, the axial insertion of the key 54 may be employed to initiate a signal, and the subsequent rotation of the key 54 initiates a desired sequence in an additional circuit that may be coupled to the assembly 10.

While the invention has been described with reference to details of the illustrated embodiment, it should be understood that such details are not intended to limit the scope of the invention as defined in the following claims.

What is claimed and desired to be secured by Letters Patent of the United States is:

1. An actuating mechanism for electrical switches comprising:
   a support frame,
   at least one electrical switch mounted on said frame
   a cam rotatably mounted on said frame adjacent said switch such that said cam, upon being rotated actuates said switch at a selected angular position of said cam,
   means for rotating said cam, and
   a toggle mechanism secured to said frame and to said cam, said mechanism including means for resisting rotation of said cam for a first portion of said rotation of said cam and for assisting the rotation of said cam during a second portion of the rotation of said cam to said selected angular position.

2. The actuating mechanism set forth in claim 1 further including
   means for locking said cam to prevent rotation thereof.

3. The actuating mechanism set forth in claim 2 said rotating means being operable to unlock said locking means.

4. The actuating mechanism set forth in claim 2 said locking means comprising a latch spring biased in a cam locking position to engage a recess defined in said cam.

5. The actuating mechanism set forth in claim 1 said toggle mechanism being secured to said cam at a point spaced from the point of mounting of said cam to said frame.

6. An actuating mechanism for electrical switches comprising:
   a support frame, at least one electrical switch mounted on said frame, a cam rotatably mounted on said frame adjacent said switch such that said cam, upon being rotated, actuates said switch at a selected angular position of said cam, means for rotating said cam, and a toggle mechanism secured to said frame and to said cam, said mechanism including means for resisting rotation of said cam for a first portion of said rotation of said cam and for assisting the rotation of said cam during a second portion of the rotation of said cam to said selected angular position, said means for resisting rotation of said cam including a spring mounted on a toggle, and secured at a first end to said toggle, said toggle being secured at a first end to said frame, and at a second end on said cam, said spring secured at a second end to said cam so as to be compressed thereby, said toggle and said spring secured to said cam such that the dead center position of said spring is displaced from the selected angular position of said cam.

7. An actuating mechanism for electrical switches comprising a housing, at least one electrical switch mounted on said housing, a switch cam rotatably mounted in said housing about an axis of rotation and having at least one switch actuating surface for engaging and actuating said electrical switch at a preselected angular position of said cam, means for rotating said cam to said angular position, means in said housing for allowing access of said rotating means for engagement with said cam, a biasing mechanism secured to said housing and to said cam for providing a force resisting rotation of said cam up to a first position spaced from said angular position and defining a dead center point at said first position at which the resisting force of said mechanism extends through said axis or rotation of said cam, said biasing mechanism includes a toggle secured at a first end to said housing, a second end secured to said cam at a point separate from the axis of rotation of said cam, and a biasing element attached to said toggle.

8. An actuating mechanism for electrical switches comprising a housing at least one electrical switch mounted on said housing, a switch cam rotatably mounted in said housing about an axis of rotation and having at least one switch actuating surface for engaging and actuating said electrical switch at a preselected angular position of said cam, means for rotating said cam to said angular position, means in said housing for allowing access of said rotating means for engagement with said cam, a biasing mechanism secured to said housing and to said cam for providing a force resisting rotation of said cam up to a first position spaced from said angular position and defining a dead center point at said first position at which the resisting force of said mechanism extends through said axis of rotation of said cam, said biasing mechanism includes a toggle secured at a first end to said housing and at a second end to said cam, said second end secured to said cam at a point separate from the axis of rotation of said cam, and biasing element attached to said toggle, and a locking apparatus for locking said cam relative to said housing.

9. An actuating mechanism for electrical switches comprising a housing at least one electrical switch mounted on said housing, a switch cam rotatably mounted in said housing about an axis of rotation and having at least one switch actuating surface for engaging and actuating said electrical switch at a pre-selected angular position of said cam, means for rotating said cam to said angular position, means in said housing for allowing access of said rotating means for engagement with said cam, a biasing mechanism secured to said housing and to said cam for providing a force resisting rotation of said cam up to a first position spaced from said angular position and defining a dead center point at said first position at which the resisting force of said mechanism extends through said axis of rotation of said cam, said biasing mechanism includes a toggle secured at a first end to said housing and at a second end to said cam, said second end secured to said cam at a point separate from the axis of rotation of said cam, and a biasing element attached to said toggle, a locking apparatus for locking said cam relative to said housing, said locking apparatus including a latch member secured at a first end to said housing, said cam including a slot for engagement of a second end of said latch, and a biasing member adjacent said latch for biasing said second end of said latch into said slot, said second end of said latch disengaged from said slot by said rotating means.

10. An actuating mechanism for electrical switches comprising a housing, at least one electrical switch mounted on said housing, a switch cam rotatably mounted in said housing about an axis of rotation and having at least one switch actuating surface for engaging and actuating said electrical switch at a preselected angular position of said cam, means for rotating said cam to said angular position, means in said housing for allowing access of said rotating means for engagement with said cam, a biasing mechanism secured to said housing and to said cam for providing a force resisting rotation of said cam up to a first position spaced from said angular position and defining a dead center point at said first position at which the resisting force of said mechanism extends through said axis of rotation of said cam.

11. A crew switch for energizing electrical circuits that control the operable components in a transit vehicle comprising a housing, said housing secured to said vehicle, at least one electrical component switch electrically coupled to at least one of said circuits for controlling the energization of said components, said switch being mounted on said housing, a component switch actuating member rotatably mounted in said housing about an axis of rotation, said member rotatable from a first position corresponding to a first mode of said crew switch to a second position corresponding to a second mode of said crew switch said electrical component switch including means for actuating said switch from a first to a second mode of operation, said actuating means engaged by said actuating member at an angular position of said actuating member between said first and second positions and actuated into a mode of operation by said actuating member upon engagement by said actuating member, means for rotating said actuating member, a toggle member including first and second longitudinal ends, said first end pivotally secured to said housing, said second end pivotally secured to said actuating member at a point spaced from said axis of rotation, and a resilient member mounted on said toggle member and engaging said actuating member, said resilient member compressed by said actuating member as said actuating member rotates from said first position to approximately said angular position, said resilient member applying a tensile force on said actuating member as said actuating member rotates from approximately said angular position to said second position.

12. A switch set forth in claim 11 further including means for locking said actuating member, said locking means including a latch secured to said housing, said actuating member including a capturing element for capturing said latch and locking said actuating member, a biasing member biasing said latch into engagement with said capturing element, said latch movable out of engagement with said capturing element by said rotating means thereby unlocking said actuating member.

13. A method for preventing the manipulation of an actuating mechanism for actuating electrical switches to a position intermediate distinct modes of operation of said mechanism, said mechanism being rotatably mounted in a housing, at least one switch being mounted in said housing in a position to be engaged by said mechanism, said method comprising the steps of resiliently biasing said mechanism to a first position corresponding to a first mode of operation, reducing said biasing force as said mechanism rotates to engagement with switch, substantially removing said biasing force at approximately the engagement of said mechanism with said switch, and resiliently biasing said mechanism to a second position corresponding to a second mode of operation upon said mechanism being further rotated.

14. The method set forth in claim 13 further comprising the steps of locking said mechanism in said first distinct mode of operation, and unlocking said mechanism prior to rotating said mechanism.

* * * * *